United States Patent [19]

Böe et al.

[11] Patent Number: 4,552,086

[45] Date of Patent: Nov. 12, 1985

[54] FLOAT ARRANGEMENT

[75] Inventors: Jan Böe, Bölandet; Tor-Arvid Haugland, Rykkin; Ole-Kristian Selvaer, Selvaer; Atle Kleiven, Myking, all of Norway

[73] Assignee: Geophysical Company of Norway A/S, Hovik, Norway

[21] Appl. No.: 498,195

[22] PCT Filed: Sep. 3, 1982

[86] PCT No.: PCT/NO82/00048

§ 371 Date: May 10, 1983

§ 102(e) Date: May 10, 1983

[87] PCT Pub. No.: WO83/01046

PCT Pub. Date: Mar. 31, 1983

[30] Foreign Application Priority Data

Sep. 28, 1981 [NO] Norway ..... 813291

[51] Int. Cl.[4] ..... B63B 21/16

[52] U.S. Cl. ..... 114/242; 114/245; 114/253

[58] Field of Search ..... 114/45, 48, 50, 245, 114/268, 269, 326, 331, 242, 258, 51; 405/162, 171, 185; 181/118, 120; 254/288, 277, 278; 367/115, 2, 125

[56] References Cited

U.S. PATENT DOCUMENTS

| | | | |
|---|---|---|---|
| 1,201,337 | 10/1916 | O'Neal | 114/51 |
| 2,420,072 | 5/1947 | Foote | 114/51 |
| 3,293,867 | 10/1966 | Dean | 114/326 |
| 3,402,687 | 9/1968 | Tsuji | 114/331 |
| 3,547,067 | 12/1970 | Jonkman | 114/51 |
| 3,718,207 | 2/1973 | Babb | 181/120 |
| 3,807,334 | 4/1974 | Egeberg | 114/268 |
| 4,245,578 | 1/1981 | Bianco et al. | 114/51 |

*Primary Examiner*—Galen L. Barefoot
*Assistant Examiner*—Edwin L. Swinehart
*Attorney, Agent, or Firm*—Ladas & Parry

[57] ABSTRACT

The present invention relates to a float which is provided with at least one hoist drum for a hoisting wire from a hoist. The float is provided with at least one suspension drum for a suspension wire to a suspension body. The hoisting drum and the suspension drum are rotationally coupled to each other and the wires are arranged in such a way on the drums that the suspension wires are reeled in when the hoisting wires are reeled off the hoisting drums and vice versa.

8 Claims, 2 Drawing Figures

FLOAT ARRANGEMENT

BACKGROUND OF THE INVENTION

1. Field of the Invention

This invention relates to an arrangement which serves to facilitate the launching of and taking aboard surface referenced systems. A primary use of the arrangement according to the invention is with floats adapted to carry air guns for marine seismic prospection.

Even though this arrangement has been particularly developed for seismic uses, it is near at hand to assume that it may also be used in other fields, for example within offshore oil activity and in the fisheries.

More particularly this invention is directed to a float arrangement adapted to be launched in water and to be retracted, respectively, by means of a hoist, the float being adapted to carry at least one submersible body suspended from the float by means of a wire.

2. Description of the Prior Art

A practical form of such a float having a number of submersible bodies in the form of air guns is described in European Patent Application No. EPC 81.902753.3.

SUMMARY OF THE INVENTION

What is novel and specific to the arrangement according to the present invention in the first place consists therein that the float is provided with at least one hoisting drum for a hoist wire from the hoist, that, moreover, the float is provided with at least one suspension drum for the suspension wire to the submersible body, that the hoisting drum and the suspension drum are rotationally coupled to each other, and that the wires are arranged in such a way on the drums that the suspension wires are reeled in when the hoist wires are reeled out from the hoisting drums, and vice versa.

In short, the solution stated here involves that submersible bodies for example in the form of air guns, may be hoisted to a position closely underneath the float which then in its turn may be lifted by means of a hoist, for example a telescoping boom on a seismic prospection vessel. The boom may then be retracted onto the deck of the vessel with the float and the air guns without having to pull these onboard over a slipway and further along the deck. This means that the equipment may more easily be lauched and retracted at the same time as reducing to a high degree the stresses imposed upon such equipment when pulled up from the water to the deck via a slipway or the like.

BRIEF DESCRIPTION OF THE DRAWINGS

The invention shall be explained more closely in the following with reference to the drawing, in which.

DESCRIPTION OF THE PREFERRED EMBODIMENTS

Figure 1:
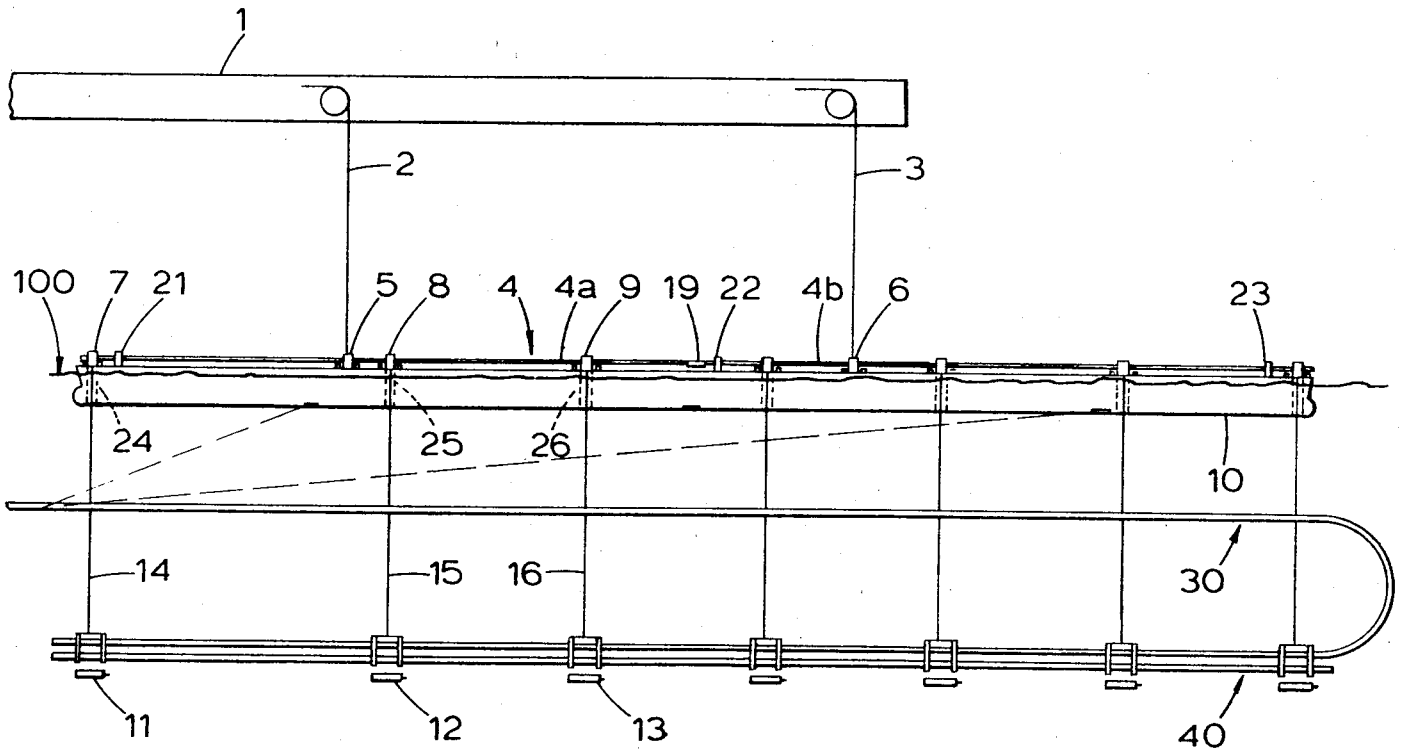
FIG. 1 schematically shows an arrangement according to the invention in side view.

FIG. 1 shows a bouy or body 10 in the form of an elongated float or the like which has been lowered to the water surface 100 by means of a hoist in the form of a boom 1 having hoisting wires 2 and 3. Besides, in the position shown air guns 11, 12 and 13 have been lowered from the float 10 and are suspended in the positions shown by means of suspension wires 14, 15 and 16. The remaining four air guns with their wires being shown in FIG. 1, correspond completely to the above air guns 11, 12 and 13 and shall not be described in detail in the following.

For the towing of the float with air guns during seismic prospection the wires 2 and 3 are detached from the boom 1 so that the float 10 may be brought into a desired position with respect to the vessel, determined, inter alia, by the length of the towing wire. According to common practice a number of floats with associated air guns may be towed in certain configurations in order to obtain defined sound radiation patterns from the air guns as a whole. At 30 and 40 there are indicated hoses and conduits for supplying compressed air and control signals etc. to the air guns.

On the float 10 there is mounted an axle 4 for example by means of bearing supports 21, 22 and 23 and the complete axle 4 may be sub-divided into two sections **4*a* and 4*b* by means of a flexible coupling 19**. Such subdivision of the axle into two or more sections may be practical depending upon the total length of the axle and upon the design of the float.

In the first place the axle 4 carries two hoisting drums 5 and 6 for the respective hoisting wires 2 and 3. Moreover, the axle carries a total of seven suspension drums of which there is here referred to the three suspension drums 7, 8 and 9 for the respective air guns 11, 12 and 13 with associated suspension wires 14, 15 and 16. For their respective drums these wires are passed through vertical channels 24, 25 and 26, respectively, in the float. It is obvious that when the drawing shows a total number of seven air guns, this is only a pure example, since the number of air guns in such an arrangement may of course be larger or smaller than this. In other uses it may be contemplated that it would be of interest to have only one single submersible body and that it would be sufficient with one single hoisting wire. In such case the float will only comprise one hoisting drum and one suspension drum.

The manner of operation of the arrangement as illustrated in the drawing, is as follows:

When the equipment is to be launched from the vessel, the hoisting wires 2 and 3 are tight and the hoisting drums 5 and 6 more or less empty of wire, whereas on the other hand the suspension drums 7, 8 and 9 having the associated wires 14, 15 and 16 full reeled in so that the air guns 11, 12 and 13 are suspended closely underneath the float 10, i.e. in engagement with the bottom thereof.

The hoist boom 1 has a cantilevered position with respect to the vessel, and the float 10 is lowered by paying out the hoist wires 2 and 3. When the float has reached the water, continued paying-out of the hoisting wires means that the air guns 11, 12 and 13 start to sink from the float 10. This causes rotation of the axle 4 so that the suspension wire is reeled out from the respective drums 7, 8 and 9, whereas the hoisting wires 2 and 3 are reeled in onto the hoisting drums 5 and 6.

When the suspension drums 7, 8 and 9 have become empty or the lowering of the air guns 11, 12 and 13 is stopped in some other way, these will be suspended in their correct depth under the float 10. The hoisting wires 2 and 3 will be reeled onto the hoisting drums 5 and 6 and by means of shackles these wires may be disconnected from the hoist and fastened in a suitable manner to the float 10 or to a towing wire, so that the air gun array on the float may be brought into a desired position in the water for the towing. The boom 1 may then be retracted for fetching possible additional floats which shall be used in the arrangement of air guns to be used for the seismic prospection concerned.

When the float 10 with associated air guns shall be taken aboard after completion of the task, the procedure will be the opposite of what has been sketched above, since the hoisting wires 2 and 3 must be connected to the hoist, i.e. to wire ends which have been pulled out on the boom 1 so that hoisting may be commenced by means of a winch onboard the vessel. During hauling-in of the hoisting wires 2 and 3 these will first be reeled off from the hoisting drums 5 and 6 so that the axle 4 rotates and thereby causes the suspension drums 7, 8 and 9 to reel in the suspension wires 14, 15 and 16 until the air guns have been lifted to a position closely underneath the bottom of the float 10. When the guns have arrived at this position, continued hauling-in of the hoisting wires 2 and 3 means that the float 10 is lifted from the water and possibly to a position closely underneath the boom 1. Then the boom 1 may be retracted over the deck of the vessel and the whole equipment with float and air guns may be parked and disconnected so that the boom will be ready for the possible hauling-in of other floats with associated air guns.

From the above it should be apparent that the handling of such floats with submersible bodies is provided for in a comparatively simple and practical manner. When the submersible bodies have been elevated by means of the wires 14, 15 and 16 on the drums 7, 8 and 9, the whole equipment has been transformed to a comparatively compact unit which can without significant problems be removed and stored during the operation of for example seismic prospection vessels. The function described has been obtained without the necessity of having motor installations of the float. The whole arrangement is very simple and reliable, conforming to the requirement to such equipment for use at sea, both in oil activity as for example for fishery purposes.

As explained above the submersible body or the air gun itself constitutes a stop member being in cooperation with the bottom of the float 10, adapted to arrest the suspension wire against continued reeling when hauling-in the float. Specific stop members may be contemplated for the same purpose, depending upon, inter alia, the type of submersible body concerned and the design of the float.

The rotational coupling of the respective drums as shown in the drawing, is effected directly through the continuous axle 4. Obviously, there may be thought of more complicated embodiments in which for example axle sections may be arranged at an angle to each other and in which there is used a gear transmission between the drums. The same fundametal function will also be obtainable in such embodiments. Thus, with a gear transmission the rate of rotation and thereby the velocity of reeling-in and reeling-off, respectively, may be separately adjustable for the individual drums. Without such gear transmission, variations of the drum diameters may also be utilized as a means of obtaining specific velocity relationship desired for the various wires involved in the arrangement. Normally, however, an arrangement having two or more hoisting wires from a hoist means, will provide for associated hoisting drums being designed for the same wire velocity. In such case it is an advantage in practice that these hoisting drums have the same diameter.

When employing an elongated float as for example shown in the Norwegian patent application referred to initially, it is convenient to arrange the suspension drums with axial alignment both mutually and with respect to the hoisting drums. The common drum axle runs in the longitudinal direction of the float in such an embodiment. Preferably, in this embodiment all wires are arranged to lie in the same vertical plane, which may be located approximately centrally of the float 10.

Figure 2:
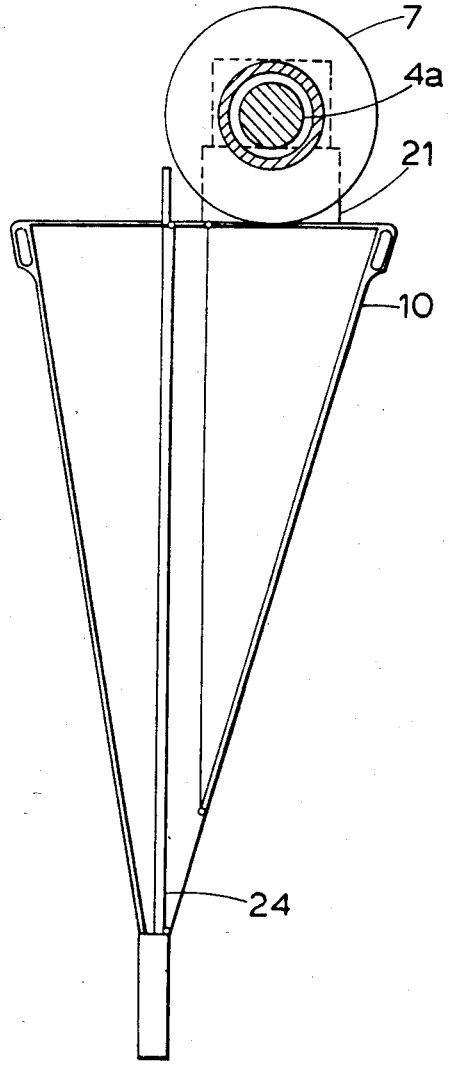
FIG. 2 shows a float in the arrangement, seen partly in section from one end and at an enlarged scale.

FIG. 2 shows more in detail the arrangement of the axle section **4*a* with drum 7 by means of the support 21 on the deck of the float 10. A suspension wire (not shown) may be passed from the drum 7 through the interior of the float 10 in the channel 24** which is open through the bottom or the keel of the float.

In a particularly simple and practical embodiment the suspension drums are designed with the same diameter as the hoisting drums.

We claim:

1. Float arrangement for marine seismic prospection comprising an elongate float and at least two submersible seismic sources carried thereby, said float and said seismic sources being adapted to be launched into water and lifted therefrom, respectively, as a unit by means of a hoist above the water surface, and said float being adapted to be towed on the water surface with said seismic sources suspended from the float by a respective suspension wire, further comprising at least two hoisting drums on the float and each with an associated hoisting wire from the hoist, a suspension drum on the float for each suspension wire, said hoisting drums and said suspension drums being rotationally coupled to each other and said wires being arranged in such a way on the drums that the suspension wires are reeled in when the hoisting wires are reeled off from the hoisting drums and vice versa, said seismic sources being adapted to constitute stop members for cooperation with the bottom of the float to arrest the suspension wires against continued reeling when the float is hauled in by means of the hoist, and stop means being provided for stopping said seismic sources when reeled out, at a predetermined distance below the float.

2. Arrangement according to claim 1, wherein there is for each suspension wire provided a vertical channel passing through the float (10).

3. Arrangement according to claim 1, wherein it comprises two hoisting wires with associated hoisting drums which are rotationally interconnected and preferably have the same diameter.

4. Arrangement according to claim 3, wherein the float has an elongate shape and is provided with two or more suspension drums which are in axial alignment mutually as well as with respect to the hoisting drums, and also in the longitudinal direction of the float.

5. Arrangement according to claim 4, wherein it comprises a common axle for all drums and being preferably subdivided into sections by means of at least one flexible coupling.

6. Arrangement according to claim 1, wherein the suspension drums have the same diameter as the hoisting drums.

7. Arrangement according to claim 4, wherein all wires are adapted to lie in the same vertical plane, preferably approximately centrally of the float.

8. Float arrangement for marine seismic prospection comprising an elongate float and at least two submersible seismic sources carried thereby, said float and said seismic sources being adapted to be launched into water and lifted therefrom, respectively, as a unit by means of a hoist above the water surface, and said float being adapted to be towed on the water surface with said seismic sources suspended from the float by a respective suspension wire, further comprising at least two hoisting drums on the float and each with an associated hoisting wire from the hoist, a suspension drum on the float for each suspension wire, said hoisting drums and said suspension drums being rotationally coupled to each other and said wires being arranged in such a way on the drums that the suspension wires are reeled in when the hoisting wires are reeled off from the hoisting drums and vice versa, said seismic sources being adapted to constitute stop members for cooperation with the bottom of the float to arrest the suspension wires against continued reeling when the float is hauled in by means of the hoist, and stop means being provided for stopping said seismic sources when reeled out, at a predetermined distance below the float, said submersible seismic sources being free of any positive buoyancy so that the respective suspension wire is reeled out when each of said submersible sources sinks by its own weight into the water.

* * * * *